US005867925A

United States Patent [19]

Fattori

[11] Patent Number: 5,867,925

[45] Date of Patent: Feb. 9, 1999

[54] SHOE TASSEL RETAINER

[76] Inventor: Robert E. Fattori, 4010 Vernon Rd., Drexel Hill, Pa. 19026

[21] Appl. No.: 899,328

[22] Filed: Jul. 23, 1997

[51] Int. Cl.[6] ..... A43B 23/00

[52] U.S. Cl. ..... 36/136; 36/1; 24/306

[58] Field of Search ..... 36/136, 1, 11; 24/306

[56] References Cited

U.S. PATENT DOCUMENTS

| | | | |
|---|---|---|---|
| 4,766,682 | 8/1988 | Malloy, III | 36/136 |
| 4,879,787 | 11/1989 | Walls | 24/306 |
| 5,214,874 | 6/1993 | Faulkner | 24/306 |
| 5,496,612 | 3/1996 | Ransbottom | 36/136 |

*Primary Examiner*—M. D. Patterson
*Attorney, Agent, or Firm*—Stephen G. Stanton; John S. Munday; Munday and Stanton

[57] ABSTRACT

A shoe tassel retainer device for use with a shoe having a flap overlying at least a part of the arch of the shoe, and at least one tassel proximate the flap. A first loop member includes a detachable attachment for adjustably fitting the first loop member over the arch of said shoe and retaining the flap. A second loop member has a portion extending from one end attached to the first loop member to its other end attached to the first loop member. One or both of the elastic loop members may be elastic. The one end of the second loop may be permanently attached to the first loop member and the other end of the second loop may be detachably attached to said the loop member, whereby the portion of the second loop member is adapted to detachably retain the tassel.

3 Claims, 3 Drawing Sheets

SHOE TASSEL RETAINER

FIELD OF THE INVENTION

The present invention relates to a protective device for shoes. More particularly, the present invention relates to a shoe tassel retainer for shoes having a flap overlying at least a part of the arch of the shoe and having at least one tassel proximate the flap. A first loop encircles the shoe around its arch and retains the shoe's flap while a second loop, affixed to the first loop, retains the shoe tassels.

BACKGROUND OF THE INVENTION

As long as shoes have been made, their owners have sought to maintain their appearance and prolong their wear. One fashionable shoe style includes one or more tassels, usually a pair, on top of the shoe as an ornamentation. In most cases the shoe also includes an ornamental flap extending from the upper edge of the shoe part way toward the toe of the shoe. Through prolonged use, misuse, or improper storage, the flap and tassels may curl or bend out of position.

Various boots have been made to overlie shoes in inclement weather to protect the shoes. Shoe trees have been made to be inserted within shoes to maintain their shape and to remove excess moisture from within the shoe. Other devices have been used to protect, for example, the shoe laces and the instep of shoes, and to protect other surfaces from shoes, such as from golf shoe spikes.

U.S. Pat. No. 3,812,603 to Goodman describes a detachable spiked shoe protective cover that increases footing on hard surfaces and prevents injury to other surfaces for wearers of spiked shoes such as golf shoes or track shoes. The bottom of the spiked shoe is placed upon a pad that has a deformable upper surface and has a shape approximating a sole of a shoe so that the spikes are contained within the pad. Resilient lateral strap members are secured to the front and rear edges of the pad and are connected by a central strap to resiliently hold and secure the pad in position against the bottom of the spiked shoe. The lateral strap members are connected by a strap and clasp member that overlies the top of the shoe, and rearward of the front edge of any shoe flap. The spiked shoes may then be worn on hard surfaces without slipping and without damaging the surface.

U.S. Pat. No. 690,003 to Altman describes a detachable shoe lace protector having a shield overlying the shoe laces of a shoe and held in place by a strap that passes through the shoe instep and connects to the other end of the strap by an eyelet/tab connector. Hooks are affixed to the upper inside end of the shield and engage the upper edge of the shoe or the laces. The Altman protector serves to completely overlie and protect the shoe laces and prevent them from becoming untied. If used with buttoned shoes, it serves solely as an ornamentation.

Somewhat similarly, U.S. Pat. No. 4,766,682 to Malloy describes a removable lace cover strap placed about the instep of laced footwear, usually athletic shoes, to prevent the laces from becoming untied. This device also serves for decorative purposes. A strap is provided with a width about equal to the instep and a length just sufficient to allow overlapping of the strap's opposite ends. A hook type fastener, such as a Velcro® fastener, may be used to fasten the strap's opposite ends together during the athletic performance of the wearer. The strap may include a ornamental design on its loop fastener patch on the upper arch of the shoe to enhance the appearance of the Malloy strap.

U.S. Pat. No. 875,560 to Vaughan describes a shoe protector designed to protect a shoe at the shank and instep when worn by miners, laborers on railways and other places where shovels or spades are used. A metal protector plate is positioned over the shank portion of the shoe and the breast portion of the heel and is held in position by an adjustable strap that passes through the instep of the shoe. The shoe is thus protected against cuts and abrasions, lengthening the life of the shoe and, perhaps more importantly, protecting the user's foot.

U.S. Pat. No. 1,901,659 to Larack describes an instep protector to be used with high heels, for example, to protect the instep of the foot from becoming sore and to allow one to wear such shoes comfortably even if one's instep is tender. The Larack device is an endless band of elastic material, such as rubber, and includes both a narrow portion and a much wider portion. The wider portion fits over the instep with the narrow portion going under the instep of the shoe. Another piece of the elastic material overlies the wider portion of the protector and forms a pocket for receiving and retaining a pad of soft textile material which may be medicated to treat an already sore instep. It is also possible to position the wider portion to protect whatever part of the foot requires protection.

U.S. Pat. No. 397,967 to Carroll describes a sandal for use over a shoe for the purpose of protecting lawns. The sole of the sandal approximates the bottom of an ordinary shoe or boot and is made from rubber, leather or other flexible material having sufficient rigidity and stiffness to serve its purpose. The forward end of the sole has toe-piece made from rubber or leather, e.g., adapted to receive the toe of the shoe or boot and is slit at the top and includes lacings to accommodate shoes/boots of varying sizes. At the rearward end of the sole is placed an upturned flange, or heel-piece, adapted to receive the heel of the shoe or boot and provide a sufficiently close fit to prevent any side motion. The bottom of the sole includes ribs or projections to increase traction on lawns. A strap or band is connected to the sole between the heel and toe through a loop at a point nearest the heel portion. A separate strap may extend around the instep of the shoe over the arch. These straps serve to position and maintain the sandal on the shoe or boot, and they may be combined into a single strap. The sole and its means of attachment serve to provide a sandal without any abrupt edge that would cut or injure the lawn.

U.S. Pat. No. 1,164,810 to Hammond describes a toe brake for use by coasters (or sled riders) that is easily attachable to a shoe and which allows the coaster to guide and brake the sled without damaging the coaster's shoe. The toe brake is positioned and retained on the center line of the shoe without presenting a fastening strap in a position to be stepped on or readily become worn out. A piece of sheet metal having a main body in the form of a shank is adapted to lie on the top of a boot or shoe and extends longitudinally. The back portion inclines upwardly and has two arms fitting the foot. The arms are provided with a strap and buckle adapted to pass around the rear of the foot to hold the toe brake in place. Another strap and buckle is secured to the shank of the sheet metal and is adapted to pass through the bottom of the shoe through its instep and prevents the device from swinging about the ankle. The straps are positioned so as to not to allow them to be stepped on or readily worn out. The braking means consists of an upwardly inclined, pointed member in line with the shank at the toe end. To strengthen the brake point, a separate piece of sheet metal is attached to the upper surface of the device and extends throughout the length of the toe point.

None of these prior art patents disclose a device to maintain and/or reform a shoe flap and tassels at or near their original positions to restore and maintain the attractive appearance of the shoes. None of the prior art patents disclose a separate portion to overly the tassels allowing a separate positioning of, and pressure against, the tassels.

Accordingly, it is an object of the present invention to provide a shoe tassel retainer specifically designed to retain or reform shoe flaps and tassels to their original, desired positions.

Another object of this invention is to provide a shoe tassel retainer having a separate retaining element for the tassels to allow precise positioning of the tassels.

Yet another object of the present invention is to provide a shoe tassel retainer having a separate retaining element for the tassels to allow exertion of just adequate pressure against the tassels to reform, but not deform, them, while at the same time exerting firmer pressure on the flap of the shoe associated with the tassels.

Other objects will appear hereinafter.

SUMMARY OF THE INVENTION

It has now been discovered that the above and other objects of the present invention may be accomplished in the following manner. Specifically, the present invention provides a shoe tassel retainer device for use with a shoe having a flap and at least one tassel.

The retainer, which is intended to be used with the shoe during storage, includes a first loop member sized for fitting over the arch of a shoe and a second loop member attached to the first loop member and positioned for retaining a tassel. At least one or, preferably, both of the loop members are elastic. The device functions to protect and maintain the 'newness' of the shoe, as the first loop member tightly presses on the shoe flap to prevent the flap from curling. The second loop member encloses the tassel, normally with less pressure than that of the first loop member, and prevents the tassel from being damaged, such as when other shoes are placed in a location proximate the tassels when the owner places the shoes in a closet or shoe rack.

In the preferred embodiment, a portion of the second loop member extends from one end, where it is permanently attached to the first loop member, to its other end, where it is detachably attached to the first loop member. Thus the portion of the second loop member passes over the top of the tassel and restrains it against the lower portion of the second loop member that is resting on the arch of the shoe. It is preferred that the second loop member is adapted to detachably retain a tassel.

The first loop member preferably also includes detachable attachment means for adjustably fitting the first loop member over the arch of a shoe. As noted above, this loop may exert greater pressure on the flap without adversely affecting the shape and expansion of the tassels.

In both loop members, various fastening means may be used for detachable attachment, such as hook type fasteners (known as Velcro® fasteners), buckles, laces, hooks, and the like. Normally the second loop member will be smaller in circumference than the first loop member, since it encloses a smaller object.

The shoe tassel retainer of the present invention may instead comprise two continuous loop straps fastened together such that the retainer is positionable on a tasseled shoe so that the larger strap overlies the shoe flap, if present, and the smaller strap overlies the tassels. One or both straps may be made from elastic material, so that no detachment means is needed, but rather the loops are expanded by hand and placed in operable position. The first loop maintains/reforms the shoe flap in its original, desired position/appearance and the second loop maintains/reforms the shoe tassels to their original, desired position/appearance.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
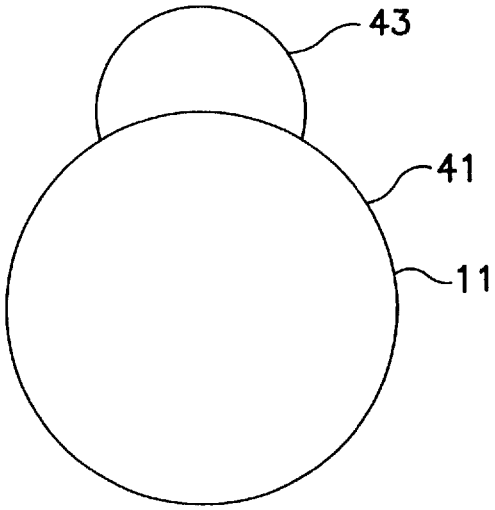
FIG. 1 is a schematic, perspective view of one embodiment of the shoe tassel retainer device of this invention.
Figure 2:
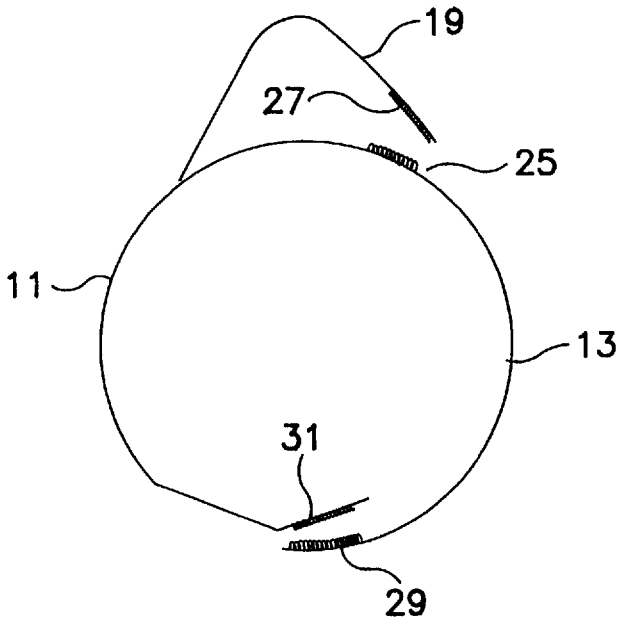
FIG. 2 is a side elevational, schematic view of the shoe tassel retainer device of the preferred embodiment of the shoe tassel retainer.

As shown in the drawings, the shoe tassel retainer device 11 made in accordance with the present invention comprises first loop member 41, to which is attached second loop member 43. In its simplest form, device 11 includes just two loop members, 41 and 43, that protect and maintain certain parts of tasseled shoes. First loop 41, usually larger in size, fits over the arch of a shoe and exerts pressure on the arch, where often a flap is placed for decorative purposes, and thus prevents the flap from curling up at its ends. Second loop 43 is placed around a tassel that is attached to, mounted on or otherwise proximate the flap, and prevents damage to the tassels as described hereinafter.

Figure 3:
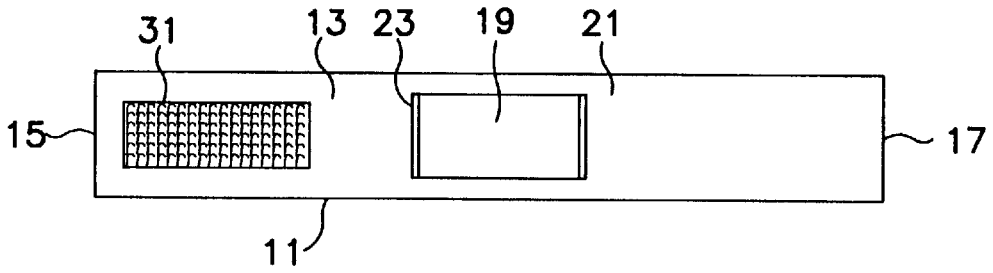
FIG. 3 is a top plan view of the shoe tassel retainer device shown in FIG. 2, prior to attachment to a shoe.
Figure 4:
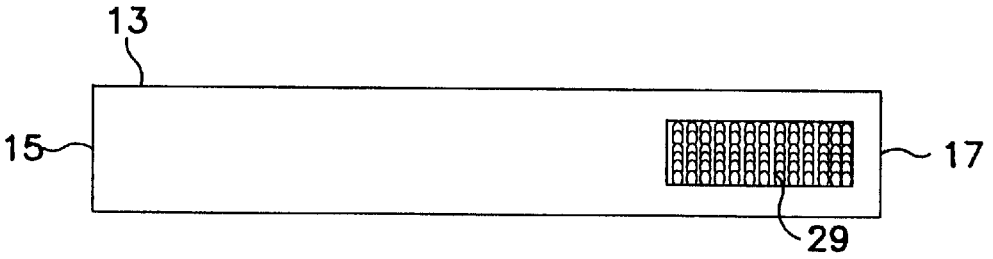
FIG. 4 is bottom plan view of the device shown in FIG. 3.
Figure 5:
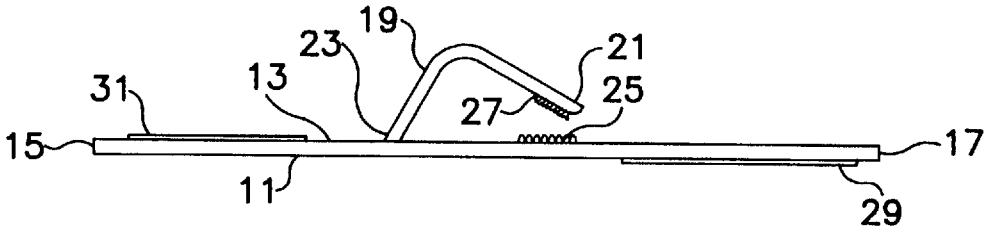
FIG. 5 is a side elevational view of the device shown in FIG. 3.

The preferred embodiment of the present invention is shown in FIGS. 2–7. As shown schematically in a ready-to-use condition in FIG. 2 and in an opened position prior to use in FIGS. 3, 4 and 5, the shoe tassel retainer device includes a first strap 13. FIG. 3 shows that strap 13 has two opposite ends 15, 17 and a shorter second strap 19 having a first end 21 and a second end 23. As shown in FIG. 5, second strap 19 is affixed to first strap 13 at the second strap's second end 23, so that, in the preferred embodiment, second strap 13 is positioned approximately mid-way between the first strap's opposite ends 15, 17. Alternatively, second strap 19 may be affixed to first strap 13 at second end 23 in any other position between the first strap's opposite ends 15, 17 as long as retainer 11 overlies the shoe's tassels as discussed below. First strap 13 and second strap 19 are preferably made of an elastic material, at least along a part of their length, to facilitate installation and to easily adjust to shoes and tassels of varying sizes.

Figure 6:
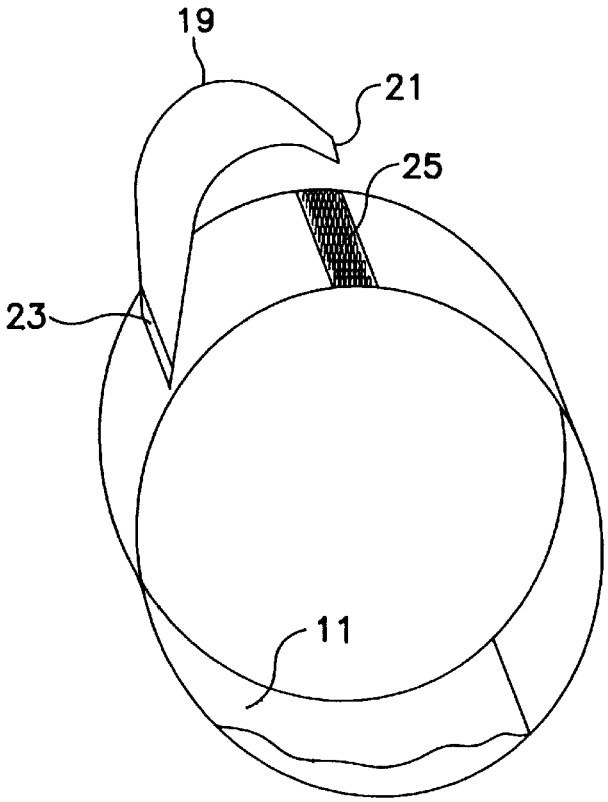
FIG. 6 is a schematic, perspective view of the shoe tassel retainer with the ends of the first loop attached and the second loop detached.

The second strap's first end 21 is detachably attached to first strap 13 by a first Velcro® fastener device comprising a hook portion 25 and a loop portion 27. As shown in FIGS. 3 and 4, the first strap's opposite ends 15, 17 are likewise attachable by a second Velcro® fastener comprising a hook portion 29 and a loop portion 31. Of course, the hook portion and the loop portions may be reversed if desired. Other suitable attachment means may be used such as, for example, snap devices, buttons and related fasteners. FIG. 6 shows the preferred embodiment of FIGS. 3–5 in an assembled position, with first Velcro® fastener device (hook portion 25 and loop portion 27 ) detached and second Velcro® fastener (hook portion 29 and loop portion 31 ) attached.

The shoe tassel retainer of the present invention is used with tasseled shoes that invariably include an ornamental flap extending from the upper edge of the shoe and continuing part way towards the toe end. The tassels, usually two, overlie and extend from the flap proximate the upper edge of the shoe and continue towards the toe end. The ends of the tassels are positioned near the toe end of the flap. Through prolonged use, misuse, or improper storage, the tassels may curl or bend out of position. The flap may also curl or bend upwards further diminishing the attractive style of the shoe. It has been discovered that use of the retainer of the present invention returns the flap and tassels to their original, intended positions, thus revitalizing the attractive appearance of the shoe and extending their useful life.

Figure 7:
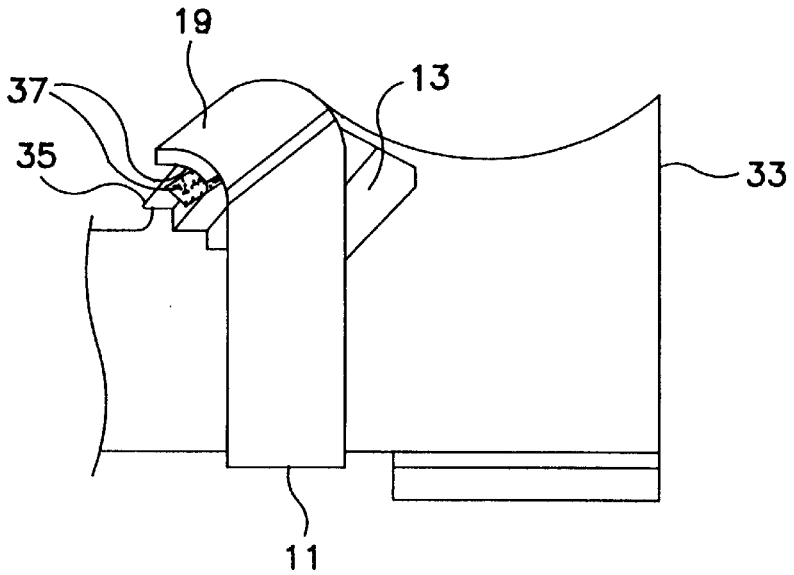
FIG. 7 is a schematic, side elevational view of the shoe tassel retainer device of this invention as positioned on a tasseled shoe.

FIG. 7 illustrates the shoe tassel retainer device 11 of the present invention positioned on shoe 33 having flap 35 and tassels 37. First strap 13 is placed around shoe 33 and its opposite ends 15, 17 are attached by second Velcro® fastener hook portion 29 and loop portion 31 so that first strap 13 overlies flap 35. The attached ends 15, 17 are usually placed under the sole of the shoe. First strap 13 is positioned so that tassels 37 are placed over first strap 13 and between second strap's first end 21 and second end 23. The second strap's first end 21 is then attached by first Velcro® fastener hook portion 25 and loop portion 27 so that second strap 19 overlies tassels 37. Thus flap 35 and tassels 37 are retained and held in their original, intended positions to reform them to these positions.

The use of second strap 19 allows more precise positioning of tassels 37 and more precise exertion of pressure against tassels 37 to ensure that the use of retainer 11 does not itself further deform tassels 37 by compressing and flattening them. This also allows first strap 13 to fully overlie flap 35 to return it to its original desired position and form while simultaneously retaining and reforming tassels 37 to their original desired positions. It is appreciated that the use of only a single strap would allow reformation of only the flap or the tassels at one time. Further, when a single strap is used to overlie the tassels, excess pressure may be exerted against the tassels in attempting to attach the opposite ends of the single strap together thus flattening and deforming the tassels against the flap. Also, the pressure of the tassels against the center of the flap may tend to upturn the lateral edges of the flap countering the reforming effects of the single strap against the flap.

Tests on tasseled shoes having deformed or mispositioned flaps and tassels have proven the use of retainer 11 of the present invention successful in repositioning the flap and tassels to, or near, their original intended positions. The tasseled shoes were returned to their intended attractive style. A comparison between a pair of shoes, one using the present invention over a period of time and the other not having the benefit of the present invention, clearly demonstrated the advantages of the device described herein. The shoe with which the invention was used, appeared as new, while the other shoe —identically treated but without benefit of the invention—looked old and misshapen.

It is possible to provide first strap 13 and second strap 19 as continuous loops without the need for first and second attachment means 25, 27; 29, 31, respectively. In its simplest form, a smaller rubber band of appropriate width, for example, could be permanently affixed to a larger rubber band also of appropriate width, such that the larger rubber band would fit around the arch of shoe 33 to overlie flap 35 while the smaller rubber band overlies tassels 37 thus reforming flap 35 and tassels 37 to their original, desired positions.

While particular embodiments of the present invention have been illustrated and described, it is not intended to limit the invention, except as defined by the following claims.

I claim:

1. In combination, a device comprising:

(a) a shoe having an arch, an upper edge, a toe end, a flap, and at least one tassel;

(b) said flap extending from said upper edge towards said toe end, said flap having a desired position and a deformed position;

(c) said at least one tassel partially overlying said flap and extending from said upper edge towards said toe end, said at least one tassel having a desired position and a deformed position;

(d) a first elastic loop member sized for fitting over said arch and said flap of said shoe with sufficient force to maintain said flap in said flap's desired position; and (e) a second elastic loop member attached to said first loop member and sized for fitting over said at least one tassel with sufficient force to maintain said at least one tassel in said at least one tassel's desired position.

2. The device of claim 1, wherein the size of said first elastic loop is adjustable.

3. The device of claim 2, wherein the size of said second elastic loop is adjustable.

* * * * *